US005307442A

United States Patent [19]

Abe et al.

[11] Patent Number: 5,307,442

[45] Date of Patent: Apr. 26, 1994

[54] METHOD AND APPARATUS FOR SPEAKER INDIVIDUALITY CONVERSION

[75] Inventors: Masanobu Abe, Kanagawa; Shigeki Sagayama, Kyoto, both of Japan

[73] Assignee: ATR Interpreting Telephony Research Laboratories, Kyoto, Japan

[21] Appl. No.: 761,155

[22] Filed: Sep. 17, 1991

[30] Foreign Application Priority Data

Oct. 22, 1990 [JP] Japan ..... 2-284965

[51] Int. Cl.[5] ..... G10L 9/06

[52] U.S. Cl. ..... 395/2.79

[58] Field of Search ..... 381/41-45, 381/51-53; 395/2.79

[56] References Cited

U.S. PATENT DOCUMENTS 4,455,615 6/1984 Tanimoto et al. ..... 381/51
4,618,985 10/1986 Pfeiffer ..... 381/51
4,624,012 11/1986 Lin et al. ..... 395/2
5,113,449 5/1992 Blanton et al. ..... 381/51
5,121,428 6/1992 Uchiyama ..... 381/42

*Primary Examiner*—Michael R. Fleming
*Assistant Examiner*—Michelle Doerrler
*Attorney, Agent, or Firm*—Lowe, Price, LeBlanc & Becker

[57] ABSTRACT

Input speech of a reference speaker, who wants to convert his/her voice quality, and speech of a target speaker are converted into a digital signal by an analog to digital (A/D) converter. The digital signal is then subjected to speech analysis by a linear predictive coding (LPC) analyzer. Speech data of the reference speaker is processed into speech segments by a speech segmentation unit. A speech segment correspondence unit makes a dynamic programming (DP) based correspondence between the obtained speech segments and training speech data of the target speaker, thereby making a speech segment correspondence table. A speaker individuality conversion is made on the basis of the speech segment correspondence table by a speech individuality conversion and synthesis unit.

13 Claims, 2 Drawing Sheets

METHOD AND APPARATUS FOR SPEAKER INDIVIDUALITY CONVERSION

BACKGROUND OF THE INVENTION

1. Field of the Invention

The present invention relates generally to methods and apparatus for converting speaker individualities and, more particularly, to a method and apparatus for speaker individuality conversion that uses speech segments as units, makes the sound quality of speech similar to the voice quality of a specific speaker and outputs speech of various sound qualities from a speech synthesis-by-rule system.

2. Description of the Background Art

A speaker individuality conversion method has conventionally been employed to make the sound quality of speech similar to the voice quality of a specific speaker and output speech of numerous sound qualities from a speech synthesis-by-rule system. In this case, a speaker individuality included in a spectrum of speech controls only some of parameters (e.g., a formant frequency in spectrum parameter, an inclination of the entire spectrum, and the like) to achieve speaker individuality conversion.

In such a conventional method, however, only such a rough speaker individuality conversion as a conversion between male voice and female voice is available.

In addition, the conventional method has another disadvantage that with respect to a rough conversion of speaker individuality, no approach to obtain a rule of converting parameters characterizing speaker's voice quality is established, thereby requiring a heuristic procedure.

SUMMARY OF THE INVENTION

A principal object of the present invention is therefore to provide a speaker individuality conversion method and a speaker individuality conversion apparatus for enabling a detailed conversion of speaker individuality by representing spectrum space of an individual person using speech segments, thereby converting the speaker's voice quality by correspondence of the represented spectrum space.

Briefly, the present invention is directed to a speaker individuality conversion method in which a speaker individuality conversion of speech is carried out by digitizing the speech, then extracting parameter and controlling the extracted parameter. In this method, correspondence of parameters is carried out between a reference speaker and a target speaker using speech segments as units, whereby a speaker individuality conversion is made in accordance with the parameter correspondence.

Therefore, according to the present invention, a speech segment is one approach to discretely represent the entire speech, in which approach a spectrum of the speech can be efficiently represented as being proved by studies of speech coding and a speech synthesis by rule. Thus, a more detailed conversion of speaker individualities is enabled as compared to a conventional example in which only a part of spectrum information is controlled.

More preferably, according to the present invention, a phonemic model of each phoneme is made by analyzing speech data of the reference speaker, a segmentation is carried out in accordance with a predetermined algorithm by using the created phonemic model, thereby to create speech segments, and a correspondence between the speech segments of the reference speaker and the speech data of the target speaker is made by DP matching.

More preferably, according to the present invention, a determination is made on the basis of the correspondence by DP matching as to which frame of the speech of the target speaker corresponds to boundaries of the speech segments of the reference speaker, the corresponding frame is then determined as the boundaries of the speech segments of the target speaker, whereby a speech segment correspondence table is made.

Further preferably, according to the present invention, the speech of the reference speaker is analyzed, a segmentation is carried out in accordance with a predetermined algorithm by using the phonemic model, a speech segment that is closest to the segmented speech is selected from the speech segments of the reference speaker, and a speech segment corresponding to the selected speech segment is obtained from the speech segments of the target speaker by using the speech segment correspondence table.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

Figure 1:
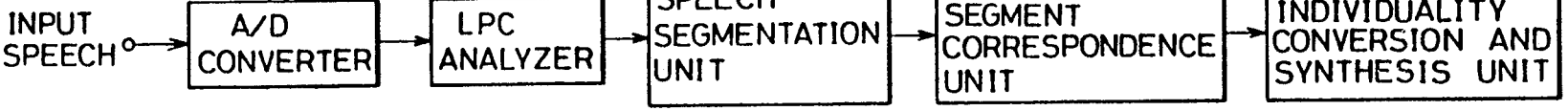
FIG. 1 is a schematic block diagram of one embodiment of the present invention.

Referring to FIG. 1, input speech is applied to and converted into a digital signal by an A/D converter 1. The digital signal is then applied to an LPC analyzer 2. LPC analyzer 2 LPC-analyzes the digitized speech signal. An LPC analysis is a well-known analysis method called linear predictive coding. LPC-analyzed speech data is applied to and recognized by a speech segmentation unit 3. The recognized speech data is segmented, so that speech segments are applied to a speech segment correspondence unit 4. Speech segment correspondence unit 4 carries out a speech segment correspondence processing by using the obtained speech segments. A speaker individuality conversion and synthesis unit 5 carries out a speaker individuality conversion and synthesis processing by using the speech segments subjected to the correspondence processing.

Figure 2:
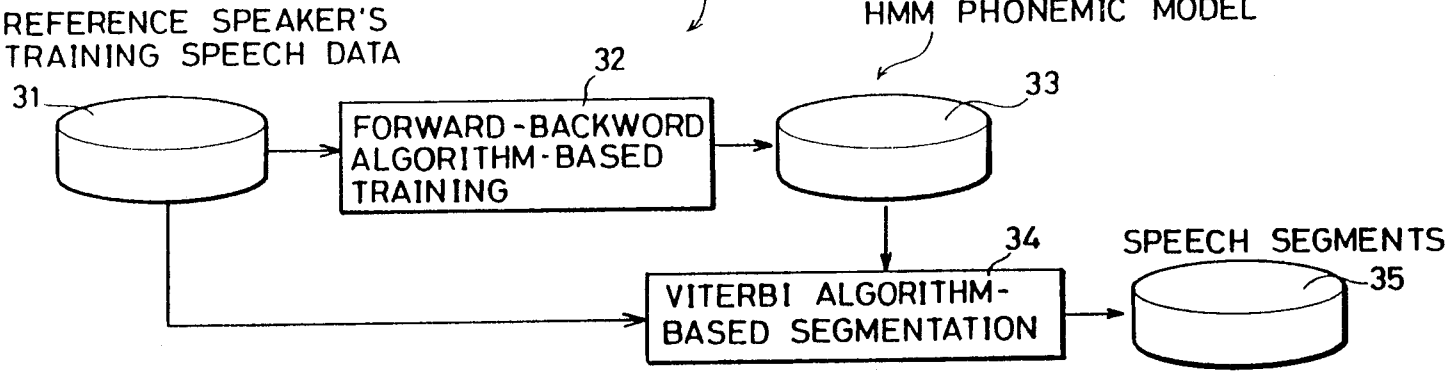
FIG. 2 is a diagram showing an algorithm of a speech segmentation unit shown in FIG. 1.
Figure 3:
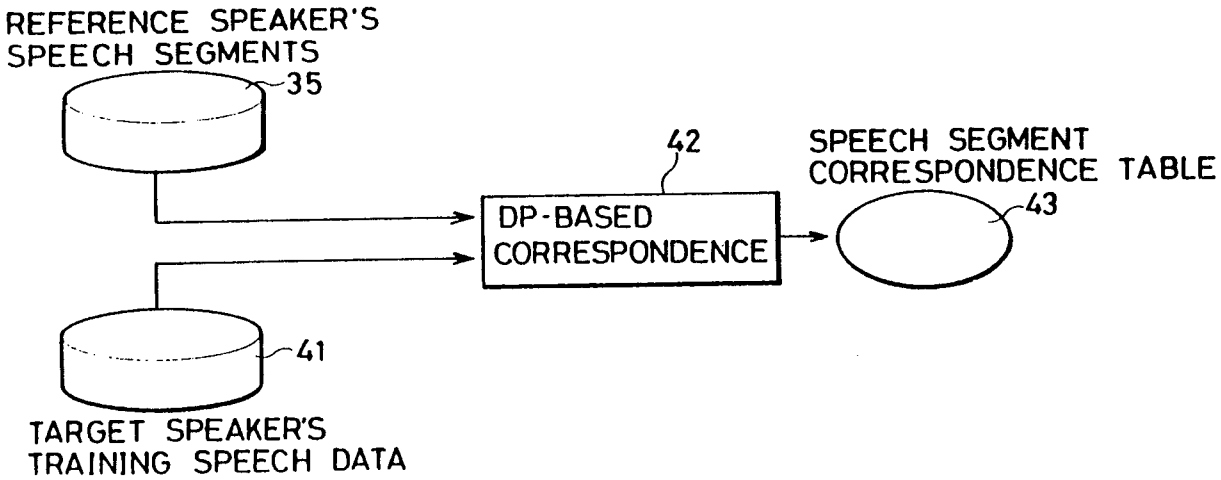
FIG. 3 is a diagram showing an algorithm of a speech segment correspondence unit shown in FIG. 1.
Figure 4:
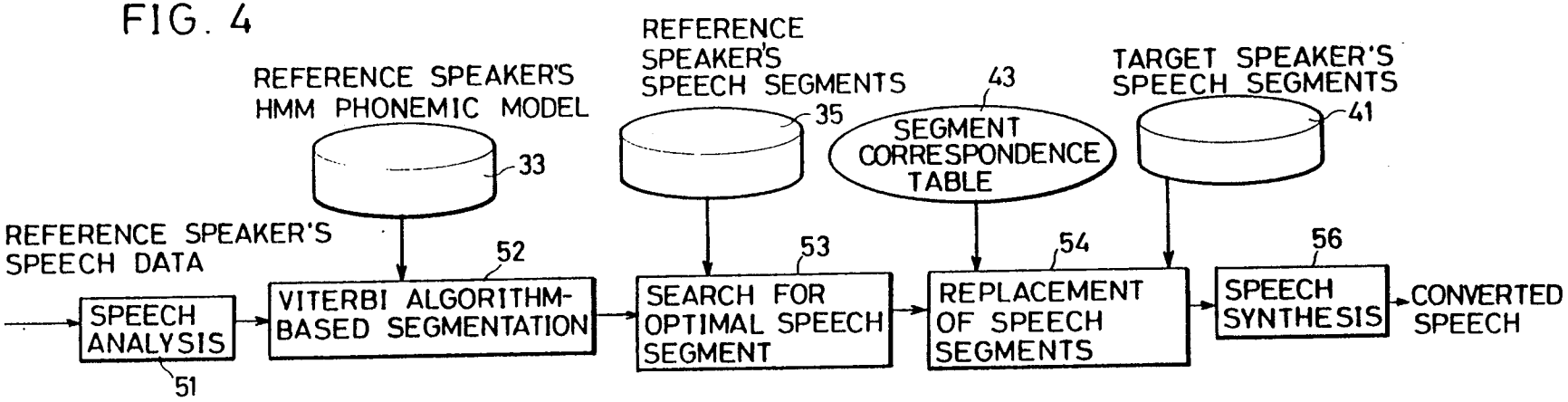
FIG. 4 is a diagram showing an algorithm of a speaker individuality conversion and synthesis unit shown in FIG. 1.

FIG. 2 is a diagram showing an algorithm of the speech segmentation unit shown in FIG. 1; FIG. 3 is a diagram showing an algorithm of the speech segment correspondence unit shown in FIG. 1; and FIG. 4 is a diagram showing an algorithm of the speaker individuality conversion and synthesis unit shown in FIG. 1.

A detailed operation of the embodiment of the present invention will now be described with reference to FIGS. 1–4. The input speech is converted into a digital signal by A/D converter 1 and then LPC-analyzed by LPC analyzer 2. Speech data is applied to speech segmentation unit 3. Speech segmentation unit 3 is comprised of a computer including memories. Speech segmentation unit 3 shown in FIG. 2 is an example employing a hidden Markov model (HMM). Speech data uttered by a reference speaker is LPC-analyzed and then stored into a memory 31. Training 32 based on a Forward-Backward algorithm is carried out by using the speech data stored in memory 31. Then, an HMM phonemic model for each phoneme is stored in a memory 33. The above-mentioned Forward-Backward algorithm is described in, for example, *IEEE ASSP MAGAZINE*, July 1990, p. 9. By using the HMM phonemic model stored in memory 33, a speech recognition is made by a segmentation processing 34 based on a Viterbi algorithm, whereby speech segments are obtained. The resultant speech segments are stored in a memory 35.

The Viterbi algorithm is described in *IEEE ASSP MAGAZINE*, July 1990, p. 3.

A speech segment correspondence processing is carried out by speech segment correspondence unit 4 by use of the speech segments obtained in the foregoing manner. That is, the speech segments of the reference speaker stored in memory 35, and the speech of the same contents uttered by a target speaker that is stored in a memory 41 and processed as training speech data are together subjected to a DP-based correspondence processing 42. Assume that the speech of the reference speaker is segmented by speech segmentation unit 3 shown in FIG. 2.

The speech segments of the target speaker are obtained as follows: first, a correspondence for each frame is obtained by DP-based correspondence processing 42 between the speech data uttered by both speakers. DP-based correspondence processing 42 is described in *IEEE ASSP MAGAZINE*, July 1990, pp. 7–11. Then, in accordance with the obtained correspondence, a determination is made as to which frame of the speech of the target speaker is correspondent with boundaries of the speech segments of the reference speaker, whereby the corresponding frame is determined as boundaries of the speech segments of the target speaker. The speech segment correspondence table is thus stored in a memory 43.

Next, speaker individuality conversion and synthesis unit 5 carries out a conversion and synthesis of speaker individualities. The speech data of the reference speaker is LPC-analyzed by LPC analyzer 2 shown in FIG. 1 and then subjected to a segmentation 52 by the Viterbi algorithm by using HMM phonemic model 33 of the reference speaker produced in speech segmentation unit 3 shown in FIG. 2. Then, a speech segment closest to the segmented speech is selected from training speech segments of the reference speaker stored in a memory 35, by a search 53 for an optimal speech segment. A speech segment corresponding to the selected speech segment of the reference speaker is subjected to a speech segment replacement processing 54 by using a speech segment correspondence table 43 made at speech segment correspondence unit 4 shown in FIG. 3 from the training speech segment of the target speaker stored in memory 41. Finally, the replaced speech segment is synthesized by using the obtained speech segment by a speech synthesis processing 56, so that converted speech is output.

As has been described heretofore, according to the embodiment of the present invention, correspondence of parameters is carried out between the reference speaker and the target speaker, using speech segments as units, whereby speaker individuality conversion can be made based on the parameter correspondence. Especially, a speech segment is one approach to discretely represent the entire speech. This approach makes it possible to efficiently represent a spectrum of the speech as being proved by studies on speech coding and a speech synthesis by rule, and thus enables a detailed conversion of speaker individualities as compared with the conventional example, in which only a part of spectrum information is controlled.

Furthermore, since dynamic characteristics as well as static characteristics of speech are included in the speech segments, the use of the speech segments as units enables a conversion of the dynamic characteristics and a representation of more detailed speaker individualities. Moreover, according to the present invention, since a speaker individuality conversion is available only with training data, an unspecified large number of speech individualities can easily be obtained.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A speaker individuality conversion method for converting speaker individuality of speech by digitizing speech data, then extracting parameters and controlling the extracted parameters, comprising:

a first step of making correspondence of parameters between a reference speaker and a target speaker, using speech segments as units, said first step including the steps of:

analyzing speech data of said reference speaker, to create a phonemic model for each phoneme, making a segmentation in accordance with a predetermined algorithm by using said created phonemic model, to create speech segments, mixing a correspondence between said obtained speech segments of said reference speaker and the speech data of said target speaker by dynamic programming (DP) matching; and a second step of making a speaker individuality conversion in accordance with said parameter correspondence.

2. The speaker individuality conversion method according to claim 1, further comprising the step of:

determining which frame of the speech of said target speaker is correspondent with boundaries of the speech segments of said reference speaker on the basis of said DP matching-based correspondence, thereby determining the corresponding frame as boundaries of the speech segments of said target speaker and thus making a speech segment correspondence table.

3. The speaker individuality conversion method according to claim 1, wherein said second step includes the steps of:

analyzing the speech of said reference speaker, to make a segmentation of the analyzed speech in accordance with a predetermined algorithm by using said phonemic model, selecting a speech segment closest to said segmented speech from the speech segments of said reference speaker, and obtaining a speech segment corresponding to said selected speech segment from the speech segments of said target speaker by using said speech segment correspondence table.

4. A speaker individuality conversion apparatus for making a speaker individuality conversion of speech by digitizing speech data, then extracting parameters and controlling the extracted parameters, said apparatus comprising:

speech segment correspondence means for making correspondence of parameters between a reference speaker and a target speaker, using speech segments as units; and speaker individuality conversion means for making a speaker individuality conversion in accordance with the parameters subjected to the correspondence by said speech segment correspondence means.

5. The speaker individuality conversion apparatus according to claim 4, wherein said speech segment correspondence means further comprises:

means for determining which frame of the speech of said target speaker is correspondent with boundaries of the speech segments of said reference speaker on the basis of said DP matching-based correspondence, thereby determining the corresponding frame as boundaries of the speech segments of said target speaker and thus making a speech segment correspondence table.

6. The speaker individuality conversion according to claim 4 wherein said speaker individuality conversion means comprises:

means for analyzing the speech of said reference speaker to make a segmentation of the analyzed speech in accordance with a predetermined algorithm by using said phonemic model;

means for selecting a speech segment closest to said segmented speech from the speech segments of said reference speaker; and means for obtaining a speech segment corresponding to said selected speech segment from the speech segments of said target speaker by using said speech segment correspondence table.

7. An apparatus for making a sound quality of a reference speaker similar to a voice quality of a target speaker, comprising:

means for analyzing the sound quality of the reference speaker and providing analyzed speech data;

means for segmenting said analyzed speech data into training speech segments;

means for determining which training speech segments of the target speaker correspond to training speech segments of the reference speaker; and means for making the sound quality of the reference speaker similar to the voice quality of the target speaker based on at least one of said training speech segments of the reference speaker, said training speech segments of the target speaker and a speech segment correspondence table based on correspondence of said training speech segments determined by said determining means.

8. The apparatus of claim 7, wherein said analyzing means comprises:

means for converting analog signals of the sound quality of the reference speaker into digital data; and mean for analyzing said digital data by coding said digital data.

9. The apparatus of claim 7, wherein said segmenting means comprises:

means for analyzing said analyzed speech data of the reference speaker to create a phonemic model for each phoneme; and means for creating said training speech segments of said analyzed data by using said phonemic model in accordance with a predetermined algorithm.

10. The apparatus of claim 9, wherein said determining means comprises:

means for correspondence processing said training speech segments of the reference speaker and speech segments of the target speaker; and means for storing corresponding frames as the boundaries between said training speech segments and speech segments of the target speaker in a speech segment correspondence table.

11. The apparatus of claim 10, wherein said making means comprises:

means for segmenting speech data of the reference speaker into speech segments in accordance with the predetermined algorithm by using the phonemic model for each phoneme of the sound quality of the reference speaker;

means for searching a speech segment closest to said segmented speech from said training speech segments;

means for obtaining a replaced speech segment corresponding to said first speech segment by using said speech segment correspondence table from said speech segment from said speech segments of the target speaker; and means for synthesizing said replaced speech segment to output a converted speech, whereby the sound quality of the reference speaker is similar to the voice quality of the target speaker.

12. The apparatus of claim 9, wherein said segmentation means further comprises means for storing said analyzed speech data, said training speech segments of said reference speaker and said phonemic model.

13. The apparatus of claim 7 further comprising means for storing speech segments of the target speaker.

* * * * *